US005551659A

United States Patent [19]

Sofy

[11] Patent Number: 5,551,659

[45] Date of Patent: Sep. 3, 1996

[54] TREE STAND

[75] Inventor: Hugh M. Sofy, Troy, Mich.

[73] Assignee: HMS Manufacturing Company, Troy, Mich.

[21] Appl. No.: 371,060

[22] Filed: Jul. 5, 1994

[51] Int. Cl.[6] ..... F16M 13/00

[52] U.S. Cl. ..... 248/523; 47/40.5

[58] Field of Search ..... 248/527, 523, 248/524, 515, 516; 47/40.5

[56] References Cited

U.S. PATENT DOCUMENTS

| | | | |
|---|---|---|---|
| D. 248,804 | 8/1978 | Budd | D6/105 |
| 1,091,000 | 3/1914 | Lyman . | |
| 1,570,403 | 1/1926 | Ripczinske . | |
| 2,044,192 | 6/1936 | Templin, Jr. . | |
| 2,260,932 | 10/1941 | Chulick et al. | 248/44 |
| 2,444,390 | 6/1948 | White | 248/44 |
| 2,487,235 | 11/1949 | Goss . | |
| 2,748,516 | 6/1956 | McClusky . | |
| 2,868,255 | 1/1959 | Fancher . | |
| 2,875,968 | 3/1959 | Ekola | 47/40.5 |
| 2,931,604 | 4/1960 | Weddle | 248/527 X |
| 3,119,586 | 1/1964 | Hoffman . | |
| 3,227,405 | 1/1966 | Layton | 248/44 |
| 3,353,773 | 11/1967 | Budd | 248/44 |
| 3,405,896 | 10/1968 | Eby | 248/44 |
| 3,480,241 | 11/1969 | Moyer . | |
| 3,861,629 | 1/1975 | Merrill | 248/38 |
| 4,130,965 | 12/1978 | Patton | 248/524 X |
| 4,190,983 | 3/1980 | Rostomily | 248/523 |
| 4,429,846 | 2/1984 | Halvorson | 248/527 X |
| 4,520,590 | 6/1985 | Schuh . | |
| 4,889,309 | 12/1989 | McCure | 248/524 |
| 5,121,897 | 6/1992 | Sofy | 248/527 |
| 5,363,591 | 11/1994 | Jones | 248/524 X |

FOREIGN PATENT DOCUMENTS

| | | | |
|---|---|---|---|
| 2629176 | 9/1989 | France | 248/523 |
| 2247408 | 4/1974 | Germany | 248/527 |
| 3003233 | 8/1981 | Germany | 47/40.5 |
| 42398 | 4/1917 | Sweden . | |

*Primary Examiner*—J. Franklin Foss

*Attorney, Agent, or Firm*—Howard & Howard Attorneys P.C.

[57] ABSTRACT

An assembly (10) for holding a tree (12) in an upright position above a level surface (14) includes a base (22) for supporting the tree (12). A rim (24) holds a quantity of water (20) on the base (22) and in contact with the tree's trunk end (16). Four retainer pins (60) hold the trunk end (16) centrally on the base means (22). A back-up retainer (32) limits trunk end (16) sliding or twisting while allowing the quantity of water (20) to flow to the trunk end (16). Guy elements (28) engage the trunk (18) of the tree at an elevated position above the trunk's end (16) and resist tree-tipping forces. Clamps (30), disposed at spaced locations around the rim (24), hold the guy elements (28) to the rim (24). Each clamp (30) has a lever arm (118) that adjustably and releasably clamps the guy elements (28) to the base (22) as the lever arm (118) is pivoted between engaged (A) and disengaged (B) positions. A reservoir fence (176) prevents objects, such as tree skirts from contacting the water (20). The assembly (10) is fully stackable when disassembled.

5 Claims, 5 Drawing Sheets

FIG-2
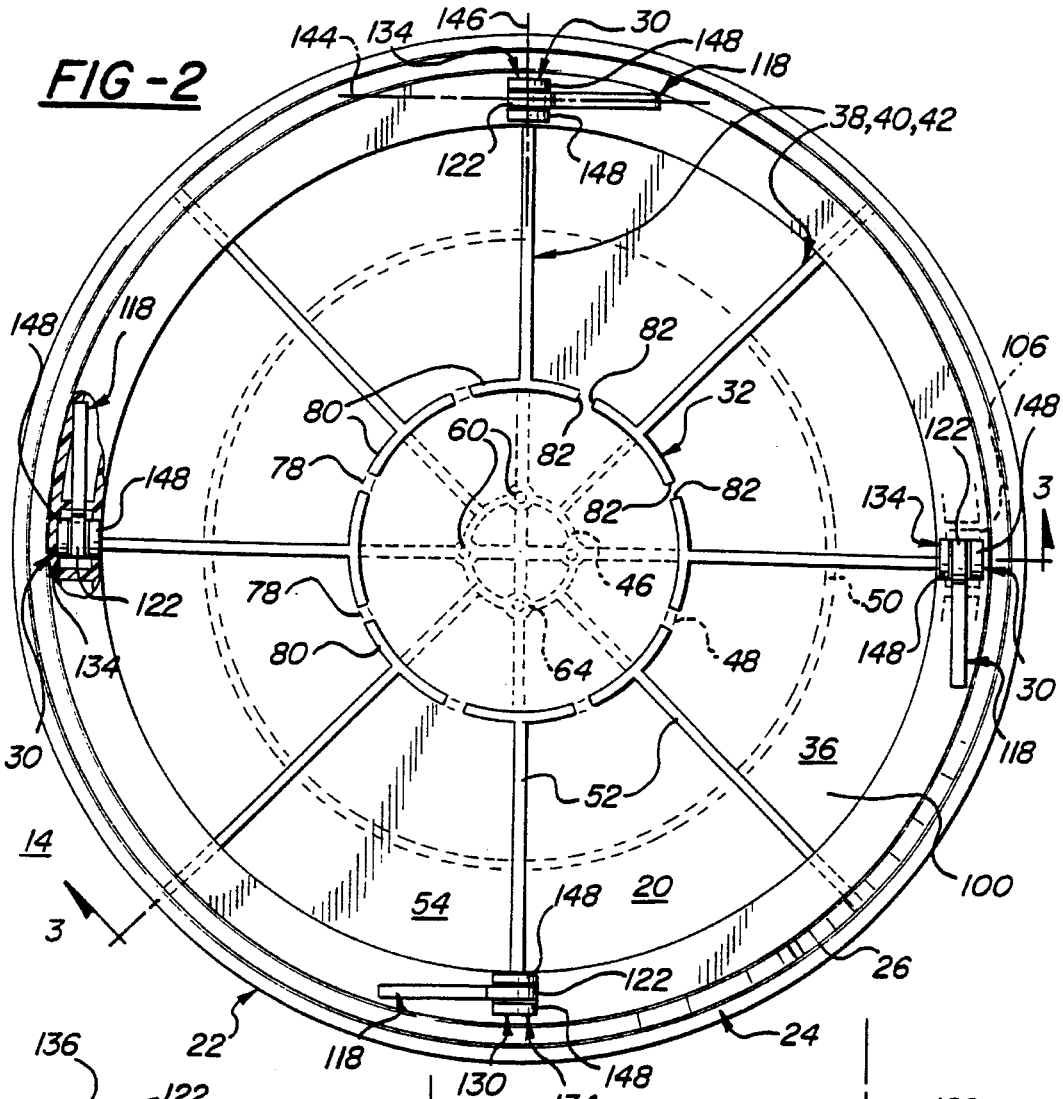
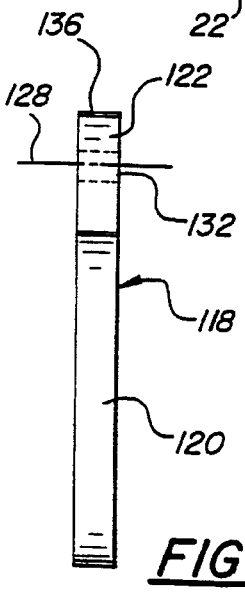
FIG-10
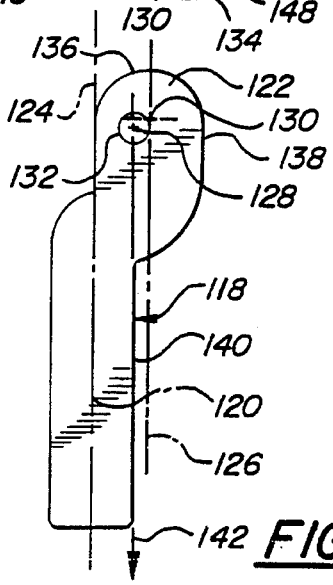
FIG-11
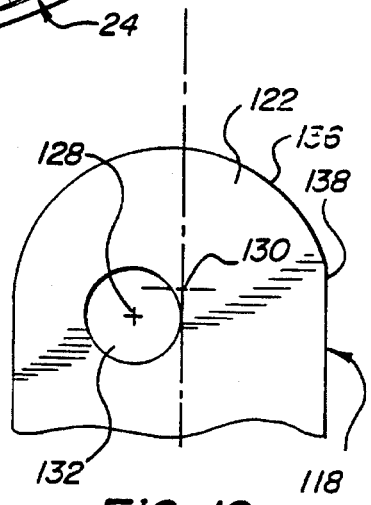
FIG-12

FIG-17
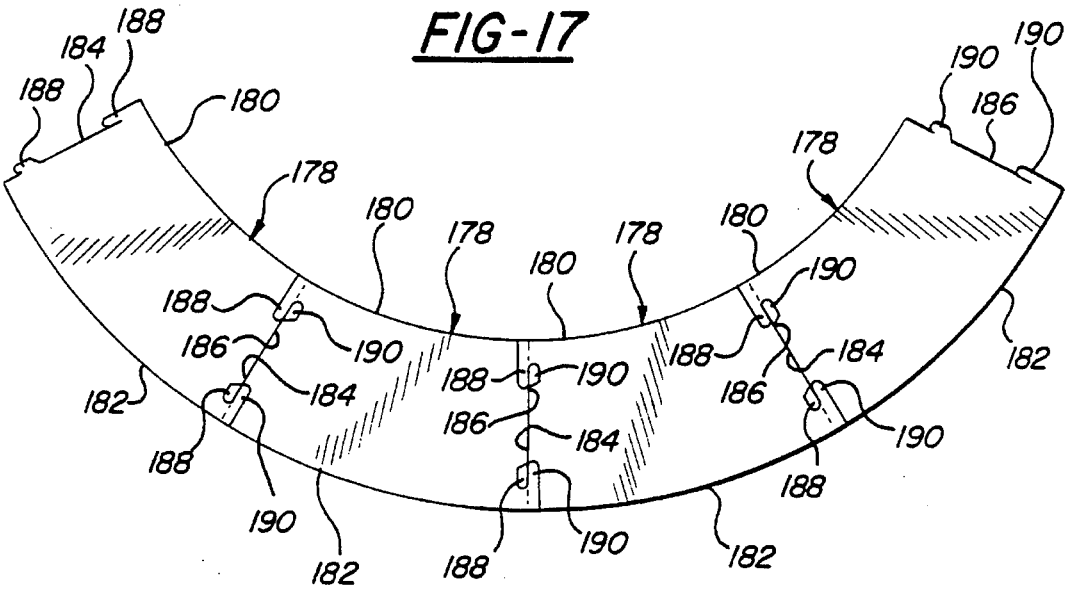
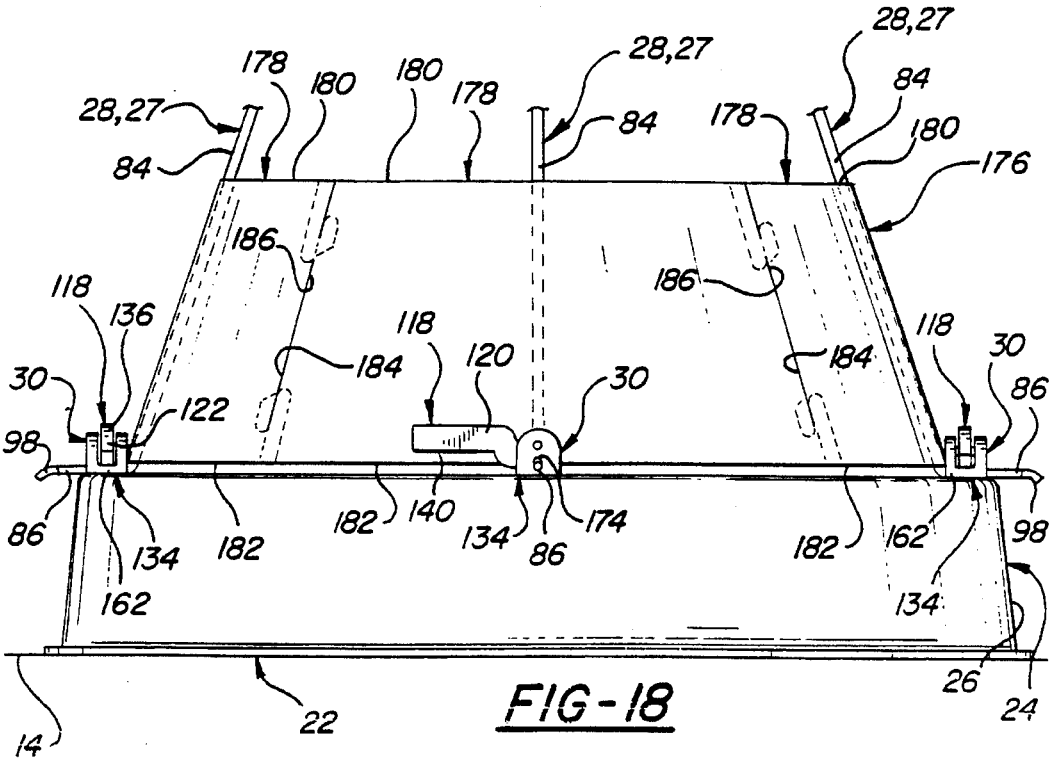
FIG-18

TREE STAND

TECHNICAL FIELD

This invention relates to a tree stand having cables to support a tree in an upright position.

BACKGROUND OF THE INVENTION

For decorative and holiday purposes it is frequently desirable to display fresh cut trees, usually evergreens, in a natural upstanding manner. A portable tree stand is used to support the tree in a natural upstanding manner while holding a quantity of water in contact with the cut end to maintain freshness. Such tree stands are of two basic types: screw type stands which use screws to engage the trunk and support the tree, and cable type stands which use cables to accomplish this. Cable-type stands are generally preferred for applications where an installer is either unable or unwilling to expend the extensive time and effort required to erect and adjust a tree's position with screws.

An tree stand that uses cables to support a tree in an upright position must have some means of preventing the cut-end of the tree's trunk from sliding sideways in relation to the tree stand. To prevent this sliding, most existing cable-type tree stands include some form of trunk-retainer to prevent this lateral movement—normally pins or spikes. It is desirable, from a safety standpoint, to include some means, other than the reservoir rim, for preventing the tree from falling should the primary retainer fail to engage the trunk-end securely enough; and, protecting against personal injury by restricting access to the often sharp primary trunk-retainer.

Unfortunately, current cable-type tree stands make no provision for the possibility that a tree may break loose from the trunk-retainer, allowing the cut-end to slide laterally and either precluding vertical tree alignment or allowing the tree to crash to the ground. If, for example, only one spike were to engage the cut-end of an unevenly-cut tree, application of force to any of the supporting cables could easily result in the trunk twisting away and possibly out of engagement with the trunk-retainer. In addition, current systems that use sharp pins or spikes as primary trunk-retainers do not restrict access to the pins or spikes, offering little protection against personal injury.

For example, U.S. Pat. No. 3,861,629 to Merrill, issued Jan. 21, 1975, discloses a cable-type tree stand with a wide reservoir, and a single upwardly-projecting spike for securing the base of the tree. Should the spike fail to adequately engage the cut end of the tree trunk, the cut end will be free to slide laterally across the reservoir, likely toppling the tree. In addition, the spike presents a significant personal injury hazard to individuals who might inadvertently step or fall into the reservoir either prior to or after tree installation.

Another example, U.S. Pat. No. 3,227,405 to J. M. Layton, issued Jan. 4, 1966, discloses a cable-type tree stand with a central depressed arcuate portion disposed in the center of its reservoir. The depressed arcuate portion has upwardly and outwardly extending sides that hold the cut end of a tree against lateral movement. Should the depressed arcuate portion fail to hold the tree's cut end, the cut end will be free to slide laterally across the reservoir floor, likely causing the tree to fall.

SUMMARY OF THE INVENTION AND ADVANTAGES

The present invention comprises an assembly for holding the trunk of a tree in an upright position above a level surface while holding the trunk's end submerged in a quantity of water. A base supports the tree's trunk end over an extended area to resist tipping. A plurality of diagonally-extending guy elements engage the trunk at an elevated position above the trunk end and resist tree-tipping forces. A rim holds a quantity of water on the base means and in contact with the trunk end. A central retainer holds the trunk end centrally on the base means. Characterizing the invention is a back-up retainer fixed to the base between the central retainer and the rim. The back-up retainer prevents the trunk end from sliding or twisting past the back-up retainer while allowing the quantity of water to flow to the trunk end.

The backup-retainer prevents the tree from sliding well out of position or falling should the primary retainer fail to engage the trunk-end securely enough. In addition, the back-up retainer protects against personal injury by restricting access to the primary trunk-retainer.

BRIEF DESCRIPTION OF THE DRAWINGS

Other advantages of the present invention will be readily appreciated as the same becomes better understood by reference to the following detailed description when considered in connection with the accompanying drawings wherein:

FIG. 2 is a top view of the invention excluding the guy elements;

FIG. 10 is a top view of the lever arm;

FIG. 11 is a front view of the lever arm;

FIG. 12 is an enlarged fragmentary view of the cam lobe portion of the lever arm;

FIG. 17 is an uncurled, partially disassembled view of the reservoir fence means;

FIG. 18 shows the reservoir fence means installed on a tree stand.

DETAILED DESCRIPTION OF THE PREFERRED EMBODIMENT

Figure 1:
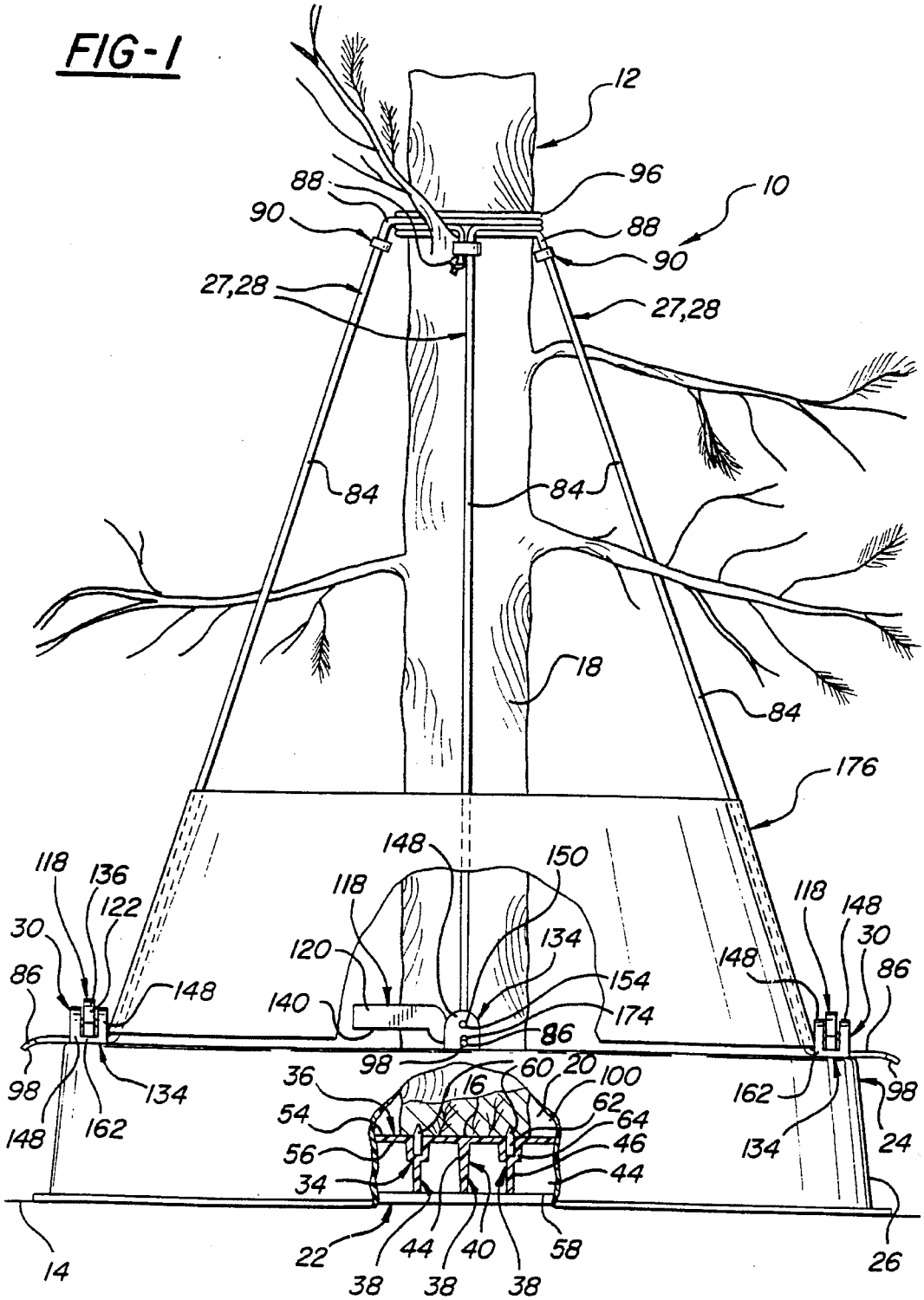
FIG. 1 is a partially cut-away side view of the invention supporting a tree.

A tree stand is generally shown at 10 in FIG. 1, for holding an artificial or natural tree 12 in an upright position above a level surface 14, and for holding the cut end 16 of the tree's trunk 18, in contact with a quantity of water 20. The assembly 10 includes base means 22 and rim means 24 that extend integrally upward from the outer periphery 26 of the base means 22. There are four guy elements 28 that extend diagonally upward from the rim means 24 to the tree's trunk 18 and four engaging means 30 disposed on the rim means 24 for engaging the guy elements 28. A backup retainer 32 extends integrally upward from the base means 22 within the rim means 24 and encircles a central trunk retainer 34. A more detailed discussion of each of these elements follows:

The base means, generally indicated at 22 in FIGS. 1, 2, 3 and 18, supports the cut-end 16 of the tree 12 over an extended area to resist tipping. The base means 22 holds the tree 12 generally perpendicular to the surface 14.

Referring to FIG. 2, the base means 22 in the preferred embodiment has a generally circular dish-shape with a circular reservoir floor 36. The base means 22 has reinforcing ribs 38 integrally extending both upward and downward from the reservoir floor 36. The reinforcing ribs 38 prevent the reservoir floor 36 from bending significantly under the weight of a tree 12 and from upward forces that the guy elements 28 transmit to the outer periphery 26 of the base means 22. In the preferred embodiment, sixteen of the reinforcing ribs 38 are radial ribs 40. Eight of the radial ribs 40 extend upward from the reservoir floor 36 and eight extend downward. Each upwardly-extending radial rib 42 is disposed directly above one of the downwardly-extending radial ribs 44. Both the upwardly 42 and downwardly 44 extending radial ribs are disposed in a radially-equidistant star-shaped pattern on the reservoir floor 36, as is best shown in FIG. 2. However, those skilled in the art will readily appreciate other rib configurations depending upon the size of the tree to be supported and the materials used in construction.

Figure 3:
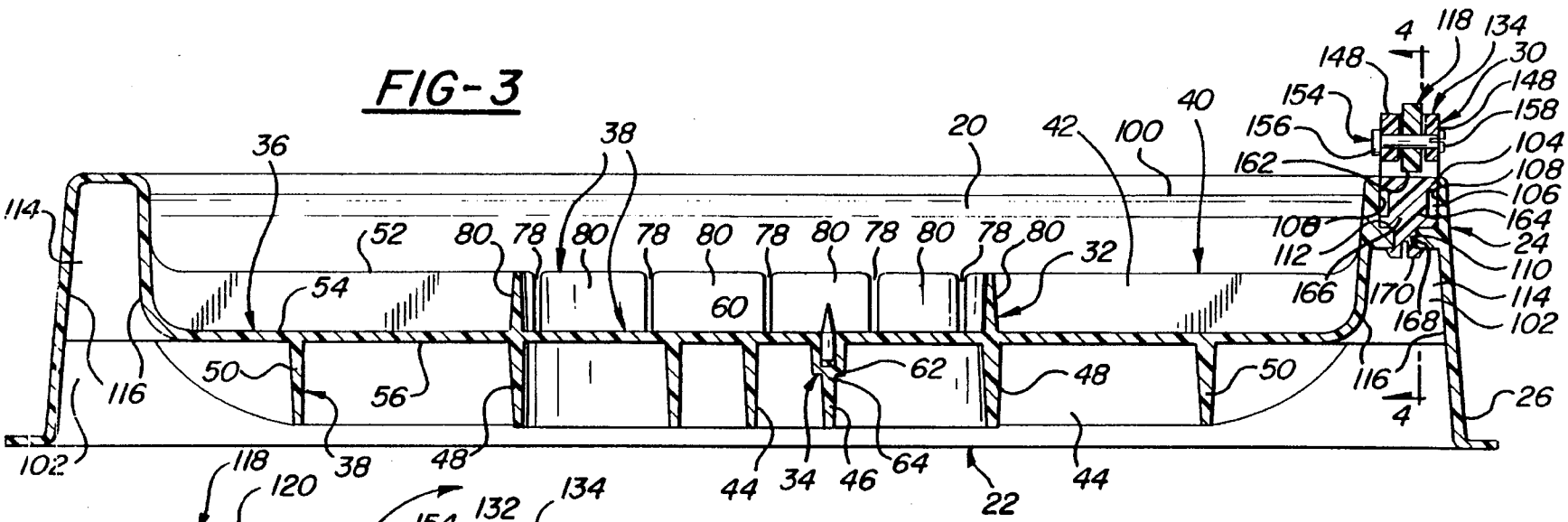
FIG. 3 is a cross-sectional view taken along line 3—3 of FIG. 2.

The reinforcing ribs 38 include downwardly-extending circular ribs, best shown at 46, 48, 50 in FIGS. 2 and 3, integrally extending from the reservoir floor 36 and intersecting the radial ribs 40. In the preferred embodiment there are inner 46, mid 48, and outer 50 circular ribs. The circular ribs 46, 48, 50 provide additional stiffness to the radial ribs 40. In other words, the circular ribs 46, 48, 50 maintain the perpendicular relationship between the radial ribs 40 and the reservoir floor 36 by intersecting the radial ribs 40.

Referring again to FIG. 2, four of the downwardly-extending radial ribs 44 join at the center in an X-shaped pattern. The other four downwardly-extending radial ribs 44 truncate at the innermost circular rib 46. All eight of the upwardly-extending radial ribs 42 extend laterally from the backup retainer 32, to the rim means 24.

The bottom edge 54 of each upwardly-extending radial rib 42 conforms to the shape of the reservoir floor's upper surface 54. The top edge 52 of each upwardly-extending radial rib 42 runs parallel to the reservoir floor 36 and curves upward at each distal end to integrally join the rim means 24. The top edge of each downwardly-extending radial rib 44 conforms to the shape of the reservoir floor's lower surface 56. The bottom edge 58 of each downwardly-extending radial rib 44 that, within the outer circular rib 50, runs parallel to the reservoir floor 36. Outside the outer circular rib 50, the bottom edge 58 of each downwardly-extending radial rib 44 tapers upward and outward, then curves upward at each outer distal end to terminate at the outer edge of the reservoir floor 36 where the reservoir floor 36 joins the rim means 24.

The central trunk retainer, generally indicated at 34 in FIGS. 1 and 3, holds the trunk 18 of the tree 12 in a central location on the base means 22 and prevents lateral trunk 18 movement relative to the base means 22. In the preferred embodiment, the trunk retainer 34 comprises four retainer pins 60. Preferably, there are at least two retainer pins 60 to prevent the tree 12 from twisting in relation to the base means 22. The trunk retainer 34 also has four retainer pin holes 62 disposed in the reservoir floor 36 and extending downward at four equally-spaced points around the inner circular rib 46. At each equally-spaced point, the upper half of the inner circular rib 46 widens into a cylindrical receptacle 64 to coaxially accommodate the retainer pin holes 62.

Figure 15:
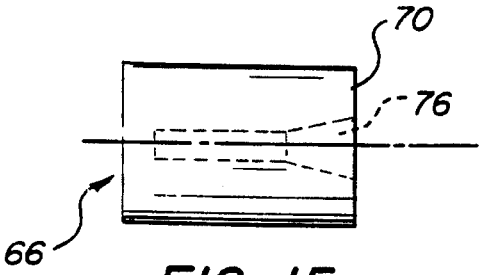
FIG. 15 is a side view of the pin installer.
Figure 16:
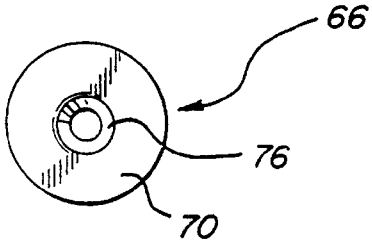
FIG. 16 is an end view of the pin installer.

The assembly 10 also includes a pin installer, generally shown at 66 in FIGS. 15 and 16, for protecting the point of each retainer pin 60 as an assembler drives each retainer pin 60 into force-fit engagement with each retainer pin hole 62. The pin installer 66 is a solid nylon cylinder. The pin installer 66 has a tapered hole 76 extending from the first end 70 inward that approximately matches the taper on the point of each retainer pin 60. Alternatively, the pin installer 66 may comprise a tapered hole in a portion of the engaging means 30 or other structure.

The water-permeable backup retainer is generally indicated at 32 in FIGS. 2 and 3. The backup retainer 32 is fixed to the base means 22 and is disposed between the central retainer 34 and the rim means 24. The backup retainer 32 prevents the tree trunk 18 from sliding or twisting past the backup retainer 32 while allowing the quantity of water 20 to flow to the cut-end 16.

In the preferred embodiment, the backup retainer 32 has a ring shape and is integrally and centrally disposed on the base means 22. The backup retainer 32 has eight water channels 78 spaced an equal distance apart around the backup retainer 32. The backup retainer 32 also includes eight curved panels 80 spaced equally around the backup retainer 32 and disposed in an alternating relationship with the water channels 78. The curved panels 80 have parallel sides 82 that define the water channels 78. Each curved panel 80 has one of the upwardly-extending radial ribs 42 extending perpendicularly and integrally outward from each panel's approximate mid-point. Each curved panel 80 perpendicularly extends the same distance above the reservoir floor 36 as the upwardly-extending radial ribs 42.

In other embodiments, the backup retainer 32 may have other than a ring shape, and need not have water channels 78. The backup retainer 32 may allow water to permeate through any one of a number of different means commonly used to allow water to pass through a solid structure. Examples of such means include wire mesh, through-holes, and membranes. In addition, the backup retainer 32 may be counter-sunk into the reservoir floor 36 allowing the quantity of water 20 to flow in by force of gravity.

The guy elements, generally indicated at 28 in FIGS. 1 and 18, support the tree 12 in an upright position. In the preferred embodiment the guy elements 28 engage the rim means 24 but may alternatively engage the base means 22. In the preferred embodiment there are four flexible guy elements 28. The guy elements 28 engage the trunk 18 at an elevated position above the end 16 of the tree trunk 18 and are anchored at equally-spaced locations around the rim means 24. The guy elements 28 prevent the tree 12 from tipping in relation to the base means 22 by directly transferring tree-tipping forces from the tree 12 into the rim means 24. Each guy element 28 includes a cord 84 extending between a clamp end 86 and a knotted end 88.

Figure 13:
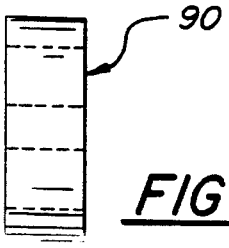
FIG. 13 is a side view of the clip.
Figure 14:
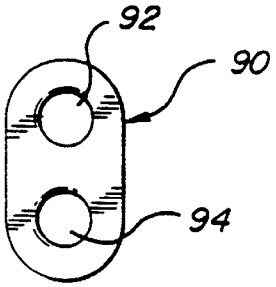
FIG. 14 is a front view of the clip.

Each guy element 28 also includes a clip, generally indicated at 90 in FIGS. 1, 13 and 14, with a first clip through-hole 92 and a second clip through-hole 94. The first 92 and second 94 clip through-holes are parallel to each other and slidably receive the cord 84 and form a loop 96 for surrounding and engaging the trunk 18. The loop 96 is formed in the cord 84 by passing the clamp end 86 of the cord 84 through one of the clip through-holes 92, 94 until the knotted end 88 of the cord 84, having a larger diameter than the clip through-hole 92, 94, arrests the cord's 84 travel. The clamp end 86 of the cord 84 is then passed around the tree trunk 18 and through the other clip through-hole 92, 94, forming a loop 96 around the tree trunk 18. The loop 96 is then cinched tightly around the tree trunk 18 and the clamp end 86 of the cord 84 is anchored, or clamped, to the rim means 24.

The cord 84 is made of diamond-braided aramid fibers and is provided with aglets, or shoelace tips 98 made of metal or plastic to prevent unraveling. A preferred aramid fiber is marketed under the trade name Kevlar®. The aramid cable is abrasion resistant, and highly resistant to elastic and plastic deformation.

The rim means, generally indicated at 24 in FIGS. 1, 2, and 3, holds a quantity of water 20 on the base means 22 and in contact with the cut-end 16 of the tree trunk 18. The rim means 24 extends upwardly from the base means 22 and defines a reservoir 100 for holding the quantity of water 20. The rim means 24 is disposed adjacent the periphery 26 of the base means 22. In the preferred embodiment, the rim means 24 is circular. The rim means 24 need not be circular, but may be any shape that will hold the quantity of water 20 on the base means 22 and in contact with the cut-end 16 of the tree trunk 18.

An inverted trough, best shown at 102 in FIG. 3, is disposed along the outer periphery 26 and directly beneath the rim means 24. The inverted trough 102 is adapted to receive another assembly's rim means 24 into nesting contact, as is best shown in phantom in FIG. 5.

The upper ridge 104 includes four square recesses 106 for receiving the engaging means 30. The square recesses 106 have slightly inwardly-tapered sides 108. Each square recess 106 also includes a recess through-hole 110 disposed in the center of the floor 112 of each square recess 106.

Figure 5:
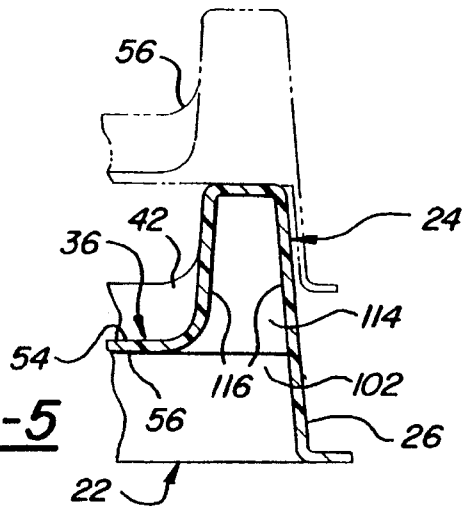
FIG. 5 is a fragmentary cross-sectional side view of the rim means showing another like tree stand in phantom and stacked for storage or shipment.
Figure 4:
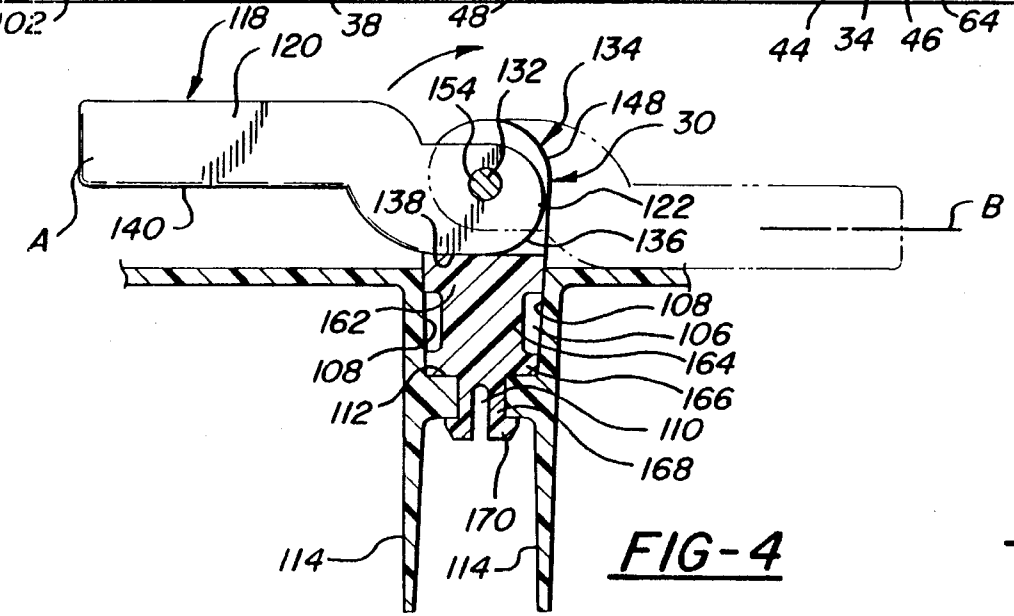
FIG. 4 is a cross-sectional view taken along line 4–4 of FIG. 3.

The rim means 24 also includes four pairs of parallel support webs, shown at 114 in FIGS. 3, 4, and 5. The support web pairs 114 are disposed within the inverted trough 102 and beneath each guy element's 28 attachment point on the rim means 24. The support web pairs 114 extend integrally and perpendicularly downward from the floor 112 of each square recess 106. The support web pairs 114 are configured to reinforce the rim means 24 at each attach point by spanning the gap between, and rigidly connecting, the rim means' inner side walls 116.

The base means 22, rim means 24 and backup retainer 32 are all formed together and comprise a single molded polyethylene unit.

The engaging means, generally indicated at 30 in FIGS. 1, 2, 3, 4, and 18, are equally spaced radially around and adjacent the rim means 24. The engaging means 30 releasably hold the cords 84 in tension to transfer tree-tipping forces from the guy elements 28 directly to the rim means 24. The rim means 24 is wide enough so that the engaging means 30 are disposed a sufficient horizontal distance from the trunk end 16 to support a tree 12 and prevent it from tipping.

Each engagement means 30 includes a lever arm, generally indicated at 118 in FIGS. 1, 2, 3, 4, 10, 11, and 18. Each lever arm 118 comprises a handgrip 120 and a cam lobe 122. The cam lobe 122 has a constant radius. The lever arm 118 has a constant thickness along its entire length and has the approximate shape of a "crooked" rectangular prism. The lever arm 118 is approximately twice as wide as it is thick and six times as long as it is wide. The handgrip end 120 is squared while the cam lobe 122 end is rounded. The handgrip has a central longitudinal axis 124 offset from and parallel to the cam lobe's central longitudinal axis 126.

To create a cam-effect, each cam lobe 122 has a rotational axis 128 that is offset toward the extended handgrip longitudinal axis 124 and away from the true radial center 130 of the cam lobe 122. Each cam lobe 122 has a pivot hole 132 disposed concentrically along its offset rotational axis 128.

Each lever arm 118 is pivotally carried on a clevis 134. Each clevis 134 is fixedly attached to the rim means 24. Each lever arm 118 adjustably and releasably clamps a corresponding cord 84 to the base means 22 as the lever arm 118 is pivoted between engaged A and disengaged B (phantom) positions, as shown in FIG. 4. Because the rotational axis 128 is offset from the radial center 130 of the cam lobe 122, downward rotation of the lever arm 118 results in progressively increasing pressure between the cam surface 136 and the clevis 134. This arrangement allows an operator to simply and quickly readjust the forces transmitted along the guy elements 28 by individually raising each lever arm 118, adjusting the longitudinal position of each cord 84 within the engagement means 30, then rotating each lever arm 118 back down to its engaged position A.

Referring to FIG. 12, the cam lobe 122 has a contact surface 136 with a flat 138 located on the contact surface 136 at the point most distant from the offset rotational axis 128. The flat 138 is perpendicular to a line drawn over the shortest distance from the offset axis to the flat 138. The flat 138 engages the cord 84 and clevis 134 when the lever arm 118 is rotated fully down into its engaged position A. The flat 138 makes the clamping engagement more secure by significantly increasing the amount of torque necessary to lift up on the handgrip 120 and move the lever arm 118 out of its engaged position A.

Each lever arm handgrip 120 has a handgrip bottom edge 140 coincident with a radial 142 extending from the offset axis and is generally parallel to the cam lobe flat 138 and the cam lobe longitudinal axis 126. Therefore, when the lever arm 118 is in its engaged position A, the handgrip bottom edge 140 is displaced upward from and parallel to the rim means 24. This upward parallel displacement is sufficient to allow a person to slide his/her fingers between the handgrip bottom edge 140 and the rim means 24 and raise the handgrip 120.

Referring to FIG. 2, each lever arm 118 has a plane of motion 144 generally perpendicular to a vertical plane 146 passing through that lever arm's corresponding cord 84. In other words, each cord 84 lies along a vertical plane 146 and the lever arm plane of motion 144 is oriented perpendicular to that vertical plane 146. In the preferred embodiment, each lever arm's plane of motion 144 is tangentially disposed in relation to the rim means 24.

Figure 6:
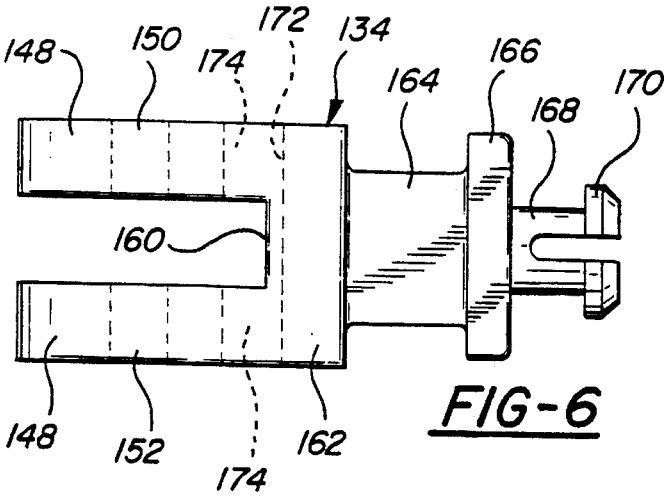
FIG. 6 is a side view of the clevis.

The clevis 134 has two parallel and upwardly-extending clevis lobes, best shown at 148 in FIG. 6. The clevis lobes 148 bracket the lever arm 118 while allowing the lever arm 118 to slidably rotate between the clevis lobes 148. The clevis 134 includes first 150 and second 152 clevis pin holes, each disposed through one of the clevis lobes 148, and aligned with and bracketing the cam lobe's pivot hole 132.

As is best shown in FIG. 3, the clevis 134 has a clevis pin 154 disposed through the first clevis pin hole 150, the cam lobe pivot hole 132, and the second clevis pin hole 152. The clevis pin 154 rotatably supports the lever arm 118 in the clevis 134. The clevis pin 154 has a disc-shaped integral pin head 156 for preventing the pin from passing completely through the first clevis pin hole 150. The clevis pin 154 also has a self-locking force-fit retainer 158. In the preferred embodiment, the force-fit retainer 158 comprises outwardly-flanged, split pin tip to allow snapping, force-fit engagement with the second clevis pin hole 152.

The clevis 134 has an anvil surface 160 disposed between and below the first 150 and second 152 clevis pin holes. The anvil surface 160 is disposed on an anvil 162 between the lobes 148. The lobes 148 extend perpendicularly upward from the anvil 162 on either side of the anvil surface 160. The anvil surface 160 provides a stationary clamping surface for opposing the force that the rotating cam lobe 122 applies. The cord 84 is pinched between the cam lobe 122 and anvil surface 160 when the lever arm 118 is rotated downward to its engaged position A.

The clevis 134 has a square mounting post 164 integrally formed beneath the anvil 162. The square mounting post 164 extends downward from the center of the anvil 162 then expands out into a square flange 166. The square flange 166 is shaped to fully occupy the lower portion of a square recess 106 when the clevis 134 is pushed downward into contact with a square recess floor 112. The anvil 162 is shaped to fully occupy the upper portion of a square recess 106 when the clevis 134 is pushed downward into contact with a square recess floor 112.

The clevis 134 has a base-engagement shaft 168 integrally formed beneath the mounting post 164 to the square flange 166. The base-engagement shaft 168 extends integrally from the center of the square flange 166 and terminates with a self-locking force-fit retainer 170. In the preferred embodiment, the self-locking force-fit retainer 170 comprises an outwardly-flanged, split shaft tip 170. The outwardly-flanged, split shaft tip 170 permits snapping engagement with the base means 22 when the clevis' base means engagement shaft 168 is forced downward into one of the four recess through-holes 110 in the rim means 24.

Figure 7:
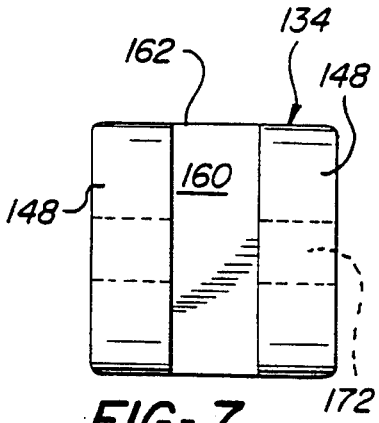
FIG. 7 is a top view of the clevis.
Figure 8:
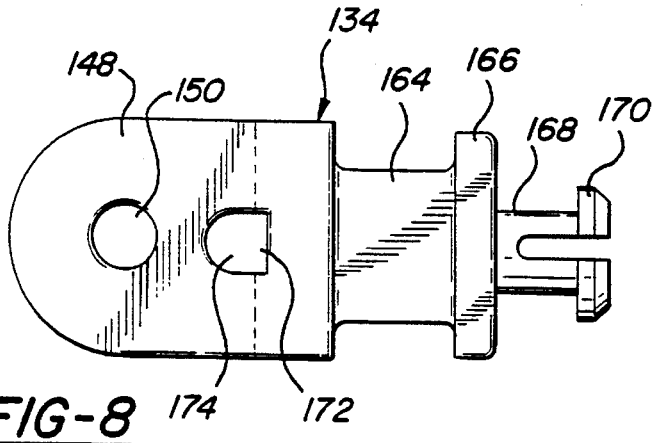
FIG. 8 is a front view of the clevis.
Figure 9:
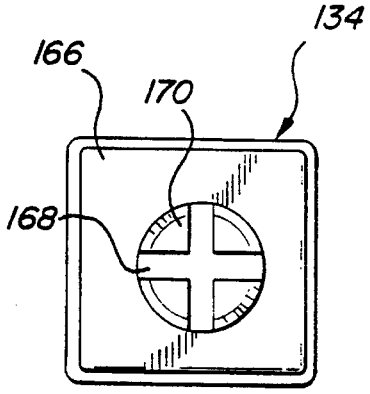
FIG. 9 is a bottom view of the clevis.

The clevis 134 has a rectangular transverse channel 172, best shown in FIGS. 6, 7 and 8, disposed in the anvil surface 160 and extending between a pair of cord openings 174. The cord openings 174 receive the cords 84 for clamping. The clamp end 86 of each cord 84, passes into the clevis 134 through the cord opening 174 closest to the assembly's 10 center. The clamp end 86 of each cable passes out of the clevis 134 through the cord opening 174 that is disposed away from the assembly's 10 center. Between the cord openings 174, the cable lies across the anvil surface 160 and within and along the rectangular transverse channel 172. Each cord's 84 position within a rectangular transverse channel 172 prevents the rotating cam lobes 122 from laterally displacing the cords 84 across their respective anvil surfaces 160 during clamping. The rectangular guide channels' 172 depths are less than their respective cords' 84 diameters so that the cords 84 take the full force of the cam lobes' 122 downward clamping pressure.

In the preferred embodiment, all the engagement means components 30 are made of nylon. Nylon has a much higher tensile strength than polyethylene and its use will preclude significant deformation in cam lobe 122 where it clamps the cord 84 against the anvil surface 160. Nylon also has a significantly higher coefficient of friction than polyethylene and will provide more resistance to cord slip. However, other materials such as metal may also be used with equal success.

To secure a tree 12 against tipping, a consumer need only position the tree 12 upright on the base means 22, pull each cord 84 through its respective engagement means 30 until taught, and rotate each lever arm 118 to clamp each cord 84 into position.

The assembly 10 includes reservoir fence means, generally indicated at 176 in FIGS. 1, 17, and 18, for preventing objects, such as tree skirts, wrapping paper, dogs, children or presents from contacting the water 20 and either splashing or wicking the water 20 out onto the surface 14. In the preferred embodiment, the reservoir fence means 176 comprises a truncated conical shell and may comprise either a solid or a meshed material. The reservoir fence means 176 may also comprise a flexible material to allow easy deformation and access to the reservoir 100 to replenish the water supply 20. In the preferred embodiment, the reservoir fence means 176 is made of single-ply cardboard or plastic.

In the preferred embodiment, and as is best shown in FIG. 17, the reservoir fence means 176 comprises four interlocking panels 178, each identical to the other in shape. Each panel 178 has a panel top edge 180, a panel bottom edge 182, a panel left edge 184 and a panel right edge 186. The top 180 and bottom edges 182 of each panel 178 are equidistant from each other and have slight, constant-radius, upward curves. The four edges 180, 182, 184, 186, of each panel 178 meet at square corners. Each panel's left edge 184 is cut to form two linearly-aligned, downward-pointing slotted fingers 188. Each panel's right edge 186 is cut to form two linearly-aligned, upward-pointing slotted fingers 190. The downward-pointing slotted fingers 188 on each panel's left edge 184 are formed to cooperatively join the upward-pointing slotted fingers 190 on each adjacent panel's right edge 186 in overlapping slotted engagement. The panels 178 are joined together to form the truncated reservoir fence means 176 with all the fingers 188, 190 visible only from the inside of the reservoir fence means 176. With the fingers Lee, 190 inward, the fingers 188, 190 are far less likely to snag or catch on foreign structures, and the fence means 176 presents a more smooth, finished appearance.

The reservoir fence means 176 is disposed on the rim means 24 but may also use the guy elements 28 for support. In the preferred embodiment, the reservoir fence means 176 is disposed over and around the cords 84 and relies for positioning and support on both the rim means 24 and the cords 84. The reservoir fence means 176 may also be used on "screw type" tree stands.

This is an illustrative description of the invention using words of description rather than of limitation. Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

I claim:

1. An assembly (10) for holding a tree (12) in an upright position above a level surface (14) while holding a trunk end (16) of the tree (12) submerged in a quantity of water (20), said assembly comprising:

base means (22) for supporting the trunk end (16) over an extended area to resist tipping;

a plurality of diagonally-extending guy elements (28) for engaging the tree (2) at an elevated position above the trunk end (16) and resisting tree-tipping forces;

rim means (24) for holding a quantity of water (20) on said base means (22) and in contact with the trunk end (16);

central retainer means (34) for holding the trunk end (16) centrally on said base means (22); and characterized by back-up retainer means (32) fixed to said base means (22) and disposed between said central retainer means (34) and said rim means (24) for preventing the trunk end (16) from sliding or twisting past said back-up retainer means (32) while allowing the quantity of water (20) to flow to the trunk end (16), said back-up retainer means (32) comprising a ring (32) disposed on said base means (22), and said ring (32) including a plurality of spaced-apart water channels (78).

2. An assembly (10) as set forth in claim 1 where said base means (22), said rim means (24) and said backup retainer means (32) are made of polyethylene.

3. An assembly (10) as set forth in claim 1 where said ring (32) includes a plurality of spaced-apart curved panels (80) disposed in an alternating relationship with said water channels (78).

4. An assembly (10) as set forth in claim 3 where said base means (22) includes a reinforcing rib (42) extending radially outwardly from each of said curved panels (80) to said rim means (24).

5. An assembly (10) for holding a tree (12) in an upright position above a level surface (14) while holding a trunk end (16) of the tree (12) submerged in a quantity of water (20), said assembly comprising:

a base (22) for supporting the trunk end (16) over an extended area to resist tipping;

a plurality of diagonally-extending guy elements (28) for engaging the tree (12) at an elevated position above the trunk end (16) and resisting tree-tipping forces;

a rim (24) for holding a quantity of water (20) on said base means (22) and in contact with the trunk end (16);

a central retainer (34) for holding the trunk end (16) centrally on said base means (22); and characterized by water-permeable back-up retainer (32) fixed to said base means (22) and disposed between said central retainer means (34) and said rim means (24) for preventing the trunk end (16) from sliding or twisting past said back-up retainer means (32) while allowing the quantity of water (20) to flow to the trunk end (16).

* * * * *